US010316273B2

(12) United States Patent
Green et al.

(10) Patent No.: US 10,316,273 B2
(45) **Date of Patent: *Jun. 11, 2019**

(54) THICKENED AQUEOUS DETERGENT LIQUID

(71) Applicant: Conopco, Inc., Englewood Cliffs, NJ (US)

(72) Inventors: Andrew David Green, Dobshill (GB); Adam Peter Jarvis, Liverpool (GB); Philip Michael Ryan, Wirral (GB); Matthew Rhys Thomas, Wirral (GB); Peter William Wills, Warrington (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/543,296

(22) PCT Filed: Jan. 7, 2016

(86) PCT No.: PCT/EP2016/050175

§ 371 (c)(1),
(2) Date: Jul. 13, 2017

(87) PCT Pub. No.: WO2016/120034

PCT Pub. Date: Aug. 4, 2016

(65) Prior Publication Data

US 2018/0002641 A1 Jan. 4, 2018

(30) Foreign Application Priority Data

Jan. 29, 2015 (EP) ..... 15153080
Sep. 10, 2015 (EP) ..... 15184721

(51) Int. Cl.
*C11D 1/02* (2006.01)
*C11D 1/12* (2006.01)
(Continued)

(52) U.S. Cl.
CPC ..... *C11D 3/3765* (2013.01); *C11D 1/02* (2013.01); *C11D 1/83* (2013.01); *C11D 3/3715* (2013.01);
(Continued)

(58) Field of Classification Search
CPC .... C11D 1/02; C11D 1/12; C11D 1/22; C11D 3/30; C11D 3/37; C11D 3/3746
See application file for complete search history.

(56) References Cited

U.S. PATENT DOCUMENTS 5,015,711 A 5/1991 Simonet et al.
8,101,027 B2 1/2012 Vandermeulen et al.
9,556,405 B2 * 1/2017 Jarvis ..... C11D 1/02

FOREIGN PATENT DOCUMENTS

EP 0896027 2/1999
EP 1721915 11/2006
(Continued)

OTHER PUBLICATIONS

Search Report & Written Opinion in PCTEP2016050175, dated Mar. 17, 2016.
(Continued)

*Primary Examiner* — Brian P Mruk
(74) *Attorney, Agent, or Firm* — Greenberg Traurig, LLP

(57) ABSTRACT

A thickened aqueous detergent liquid composition comprising: (i) at least 5 wt % (more preferably at least 10%, more preferably at least 15% and most preferably at least 20% wt.) of a surfactant system comprising anionic surfactant, (ii) a thickening system comprising a copolymer formed by the addition polymerisation of: (A) 0 to 5 wt % of a first monomer consisting of an ethylenically unsaturated diacid of formula (I): or an unsaturated cyclic anhydride precursor of such an ethylenically unsaturated diacid, the anhydride having formula (II) where $R_1$ and $R_2$ are individually selected from H, $C_1$-$C_3$ alkyl, phenyl, chlorine and bromine; (B) 15 to 60 wt % of a second ethylenically unsaturated monoacidic monomer consisting of (meth)acrylic acid; (C) 30 to 70 wt % of a third ethylenically unsaturated monomer consisting of $C_1$-$C_8$ alkyl ester(s) of (meth)acrylic acid; (D) 1 to 25 wt %, of a fourth ethylenically unsaturated monomer, consisting of surfmer of formula (III): wherein each $R_3$ and $R_4$ are each independently selected from H, $C_{1-3}$ alkyl, —C(=O)OH, or —C(=O)$OR_5$; $R_5$ is a $C_1$-$C_{30}$ alkyl; T is —$CH_2$C(=O)O—, —C(=O)O—, —O—, —$CH_2$O—, —NHC(=O)NH—, —C(=O)NH—, —Ar—$(CE_2)_z$-NHC(=O)O—, —Ar—$(CE_2)_z$-NHC(=O)NH—, or —$CH_2CH_2$NHC(=O)—Ar is divalent aryl; E is H or methyl; z is 0 or 1; k is an integer in the range of 0 to 30; and q is 0 or 1; with the proviso that when k is 0, q is 0, and when k is in the range of 1 to 30; q is 1; $(R_6O)_m$ is polyoxyalkylene, which is a homopolymer, a random copolymer, or a block copolymer of $C_2$-$C_4$-oxyalkylene units, wherein $R_6$ is $C_2H_4$, $C_3H_6$, $C_4H_8$, or a mixture thereof, and m is an integer in the range of 5 to 250; Y is —$R_6$O—, —$R_6$H—, —C(=O)—, —C(=O)NH—, =$R_6$NHC(=O)NH—, or —C(=O)NHC(=O)—; and R7 is substituted or unsubstituted alkyl selected from the group consisting of $C_8$-$C_{40}$ linear alkyl, $C_8$-$C_{40}$ branched alkyl, $C_8$-$C_{40}$ carbocyclic alkyl, $C_2$-$C_{40}$ alkyl-substituted, phenyl, aryl-substituted $C_2$-$C_{40}$ alkyl, and $C_8$-$C_{80}$ complex ester; wherein the $R_7$ alkyl group optionally comprises one or more substituents selected from the group consisting of hydroxy, alkoxy, and halogen and (E) 0 to 5 wt %, of a cross linking agent, for introducing branching and controlling molecular weight, the cross linking monomer comprising polyfunctional units carrying multiple reactive functionalisation groups selected from the group consisting of vinyl, allyl and functional mixtures thereof, and (iii) from 0.01 to 5% wt of the
(Continued)

composition ethoxylated polyamine; wherein (C) comprises from 40 to 100% C4-C8 acrylate and from 0 to 60% ethyl acrylate.

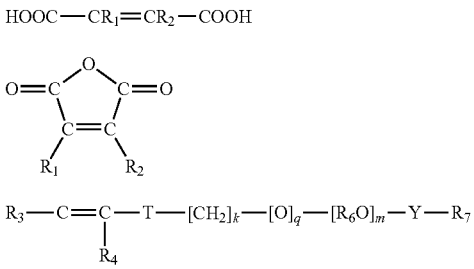

12 Claims, No Drawings

(51) Int. Cl.

| | |
|---|---|
| ***C11D 1/22*** | (2006.01) |
| ***C11D 3/30*** | (2006.01) |
| ***C11D 3/37*** | (2006.01) |
| ***C11D 1/83*** | (2006.01) |
| *C11D 1/29* | (2006.01) |
| *C11D 1/66* | (2006.01) |
| *C11D 3/00* | (2006.01) |

(52) U.S. Cl.
CPC ..... *C11D 3/3723* (2013.01); *C11D 1/22* (2013.01); *C11D 1/29* (2013.01); *C11D 1/66* (2013.01); *C11D 3/0036* (2013.01)

(56) References Cited

FOREIGN PATENT DOCUMENTS

| | | | | |
|---|---|---|---|---|
| WO | WO2008017620 | | 2/2008 | |
| WO | WO2009153184 | | 12/2009 | |
| WO | WO 2014/082955 | * | 6/2014 | ..... C11D 3/37 |
| WO | WO2014082955 | | 6/2014 | |
| WO | WO2014084874 | | 6/2014 | |
| WO | WO2014100181 | | 6/2014 | |

OTHER PUBLICATIONS

Search Report in EP15153080, dated Jun. 29, 2015.
Written Opinion in EP15153080, dated Jun. 29, 2015.

* cited by examiner

THICKENED AQUEOUS DETERGENT LIQUID

The present invention relates to improved laundry liquid compositions.

TECHNICAL FIELD

This invention relates to thickened aqueous detergent liquid compositions comprising as thickener an alkali swellable acrylic based rheology modifying polymer emulsion with hydrophobic modification, or HASE polymer.

BACKGROUND

A trend in detergent formulating is to reduce the amount of surfactant and to replace these petrochemical derived ingredients with highly weight efficient ingredients selected from cleaning and soil release polymers, sequestrants and enzyme cocktails. Typically some surfactant is retained in the composition and the work horse surfactant linear alkyl benzene sulphonate (LAS) is frequently a key part of the surfactant blend. The polymer ethoxylated polyethylene imine may be used as one of the weight efficient ingredients. Suitable compositions are taught, for example, in WO 09/153184.

To meet consumer preference it is desirable to thicken concentrated detergent liquids. However, the thickening system does not contribute to the cleaning performance of a product as used in a washing machine. There is some evidence that it can under certain conditions even reduce cleaning performance. A weight efficient thickening system with low cleaning negatives is desirable.

Hydrophobically modified alkali swellable emulsion (HASE) copolymers are known as synthetic associative thickeners. These copolymers typically contain a backbone comprising a major part of residues of randomly distributed methacrylic acid (MAA) and ethylacrylate (EA) monomers. Inserted into this backbone are a small proportion of hydrophobically modified groups, usually less than 3 mol %. The monomers to form these hydrophobic groups are sometimes referred to as surfmers or associative monomers. Due to its structure, the copolymer, when dissolved in an alkaline aqueous liquid, induces a variety of interacting forces such as hydrophobic, hydrogen bonding, electrostatic, etc and this modifies the rheology of the liquid. It is further known that the HASE copolymers and their thickening behaviour may be further modified by use of crosslinkers. HASE copolymers are usually synthesized via emulsion polymerization.

U.S. Pat. No. 5,015,711 (Coatex) discloses a thickening terpolymer of the MAA/EA/surfmer type.

WO 2014/082955 (Unilever) and WO 2014/082874 (Unilever) disclose thickened liquid laundry compositions containing thickening polymer derived from ethyl acrylate (EA), methacrylic acid (MMA), maleic anhydride (MA) and surfmer components. The compositions contain surfactant and ethoxylated polyamine (EPEI).

It would be desirable to provide a weight efficient thickening system which exhibits a reduced negative impact on the cleaning performance of a thickened aqueous detergent liquid.

SUMMARY OF THE INVENTION

According to the present invention there is provided a thickened aqueous detergent liquid composition comprising:

(i) at least 5 wt % of a surfactant system comprising anionic surfactant, (ii) a thickening system comprising a copolymer formed by the addition polymerisation of:

(A) 0 to 5 wt % of a first monomer consisting of an ethylenically unsaturated diacid of formula (I):

$$HOOC—CR_1{=}CR_2—COOH \quad (I)$$

or an unsaturated cyclic anhydride precursor of such an ethylenically unsaturated diacid, the anhydride having formula (II)

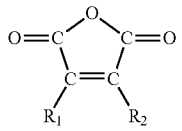

(II)

where $R_1$ and $R_2$ are individually selected from H, $C_1$-$C_3$ alkyl, phenyl, chlorine and bromine;

(B) 15 to 60 wt % of a second ethylenically unsaturated monoacidic monomer consisting of (meth)acrylic acid;

(C) 30 to 70 wt % of a third ethylenically unsaturated monomer consisting of $C_1$-$C_8$ alkyl ester(s) of (meth) acrylic acid;

(D) 1 to 25 wt %, of a fourth ethylenically unsaturated monomer, consisting of surfmer of formula (III):

$$R_3—C{=}C(R_4)—T—[CH_2]_k—[O]_q—[R_6O]_m—Y—R_7 \quad (III)$$

wherein each $R_3$ and $R_4$ are each independently selected from H, $C_{1-3}$ alkyl such as methyl, —C(=O)OH, or C(=O)$OR_5$;

$R_5$ is a $C_1$-$C_{30}$ alkyl;

T is —$CH_2$C(=O)O—, —C(=O)O—, —O—, —$CH_2$O—, —NHC(=O)NH—, —C(=O)NH—, —Ar—$(CE_2)_z$-NHC(=O)O—, —Ar—$(CE_2)_z$-NHC(=O)NH—, or $CH_2CH_2$NHC(=O)—;

Ar is divalent aryl;

E is H or methyl;

z is 0 or 1;

k is an integer in the range of 0 to 30; and q is 0 or 1; with the proviso that when k is 0, q is 0, and when k is in the range of 1 to 30; q is 1;

$(R_6O)_m$ is polyoxyalkylene, which is a homopolymer, a random copolymer, or a block copolymer of $C_2$-$C_4$-oxyalkylene units, wherein $R_6$ is $C_2H_4$, $C_3H_6$, $C_4H_8$, or a mixture thereof, and m is an integer in the range of 5 to 250; Y is $R_6$O—, —$R_6$H—, —C(=O)—, —C(=O)NH—, =$R_6$NHC(=O)NH—, or —C(=O)NHC(=O)—; and $R_7$ is substituted or unsubstituted alkyl selected from the group consisting of $C_8$-$C_{40}$ linear alkyl, $C_8$-$C_{40}$ branched alkyl, $C_8$-$C_{40}$ carbocyclic alkyl, $C_2$-$C_{40}$ alkyl-substituted, phenyl, aryl-substituted $C_2$-$C_{40}$ alkyl, and $C_8$-$C_{80}$ complex ester; wherein the $R_7$ alkyl group optionally comprises one or more substituents selected from the group consisting of hydroxy, alkoxy, and halogen;

and (E) 0 to 5 wt %, of a cross linking agent, for introducing branching and controlling molecular weight, the cross linking monomer comprising polyfunctional units carrying multiple reactive functionalisation groups selected from the group consisting of vinyl, allyl and functional mixtures thereof.

(iii) from 0.01 to 5% wt of the composition ethoxylated polyamine, wherein (C) comprises from 40 to 100% C4-C8 acrylate and from 0 to 60% ethyl acrylate.

In this specification the term (meth)acrylic acid includes both acrylic acid and methacrylic acid and the term (meth) acrylate includes both acrylate and methacrylate.

Preferably Surfmer D has the formula (IV)

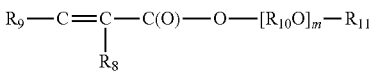

(IV)

where:

$R_8$ and $R_9$ are each independently selected from H, and $C_{1-3}$ alkyl;

$R_{10}$ is $C_2$-$C_4$ and mixtures thereof, preferably $C_2$;

m, the average number of alkoxy units $R_{10}O$, is from 6 to 40;

$R_{11}$ is alkyl or alkylaryl where the alkyl part is linear or branched; and the total number of carbons is from 10 to 40.

The viscosity of the liquid at 20 $s^{-1}$ and 25° C. is preferably at least 0.2 Pa·s, more preferably at least 0.3 Pa·s and most preferably at least 0.4 Pa·s.

The compositions preferably comprise at least 0.3 wt %, more preferably at least 0.6 wt % of the copolymer (ii). Because the copolymer is very weight effective the composition advantageously comprises less than 1.5 wt %, even less than 1 wt % of the copolymer (ii).

Copolymer (ii) preferably has a molecular weight Mw of over 250 000, more preferably over 500 000 Daltons.

The copolymers (ii) are preferably linear, that is uncross-linked, alkali swellable hydrophobically modified acrylic copolymers, HASE. Such copolymers comprise 0% of (E). These polymers require alkaline conditions to swell and so should be added to the composition such that they are exposed to alkaline conditions at some stage during the manufacture of the detergent liquid.

In order to provide maximum charge density and improved swelling it is preferred to use maleic acid as a diacid (A) in copolymer (ii). Conveniently maleic anhydride is used as the first monomer A in the copolymerisation if a diacid monomer (A) is employed.

Compositions comprising the thickening copolymers as claimed may be manufactured easily by simple addition of the polymer to the composition. The prior art polymers may phase separate and give rise to lack of clarity of the composition when used in this way. The copolymers made with butyl acrylate have been found to give thickened detergent liquids of high clarity, whatever process is used to make them. The compositions containing copolymers made with butyl acrylate are also shown to exhibit improved cleaning performance, especially in terms of removal of particulate stains, as compared to compositions containing copolymers derived from ethyl acrylate.

DETAILED DESCRIPTION OF THE INVENTION

First Monomer A

The copolymer may be formed using a First Monomer A which may ring open to form a diacidic unit in the polymer. Diacidic unit means that carboxylate groups are attached to adjacent carbon atoms in the carbon backbone of the copolymer. Conveniently and preferably the monomer A unit is formed from a cyclic ethylenically unsaturated anhydride monomer of formula (II).

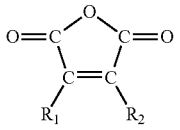

(II)

where $R_1$ and $R_2$ are individually selected from H, $C_1$-$C_3$ alkyl, phenyl, chlorine and bromine. Use of a cyclic anhydride monomer with ethylenic unsaturation gives a cis diacid if the ring opens. Such a diacid has both carboxylate groups arranged on the same side of the polymer; but on different carbon atoms.

Preferably $R_1$ is hydrogen and $R_2$ is selected from the group comprising hydrogen, methyl, bromine and phenyl. More preferably $R_1$ is hydrogen and $R_2$ is selected from hydrogen and methyl. Most preferably $R_1$ and $R_2$ are hydrogen so that the anhydride is maleic anhydride. This is the precursor for maleic acid. It is thought that because maleic acid produces carboxylate groups on adjacent carbon atoms in the polymer backbone this increases the localised charge density and causes the difference in performance compared with copolymers not containing this diacid. Itaconic acid which is outside the scope of this invention provides a polymer element where one carbon carries two carboxylate groups and the other carries none. Fumaric acid is the trans isomer of maleic acid it cannot be formed from maleic anhydride monomer by hydrolysis during the emulsion polymerization.

Monomer A, when present, may range from 0.1 to 5 wt %, preferably from 0.2 to 4 wt %, and more preferably from 0.3 to 1 wt %, and optimally from 0.4 to 0.6 wt % of the total copolymer.

Second Monomer B

The Second Monomer B is a monoacidic vinyl monomer. Suitable monomers are acrylic acid, methacrylic acid, salts of the aforementioned acids and combinations thereof.

In the compositions, the acid groups may be neutralized to form salts. Typical salt counterions to the acid groups are sodium, potassium, ammonium and triethanolammonium cations.

Amounts of the monoacidic vinyl monomer in the copolymers may range from 15 to 60 wt %, preferably from 20 to 55 wt %, more preferably from 25 to 50 wt % of the total copolymer.

Third Monomer C

The Third Monomer, C, is C4-C8 acrylate, optionally with ethyl acrylate. (C) preferably comprises from 50 to 100% C4-C8 acrylate and from 0 to 50% ethyl acrylate, more preferably comprises from 60 to 100% C4-C8 acrylate and from 0 to 40% ethyl acrylate, even more preferably comprises from 70 to 100% C4-C8 acrylate and from 0 to 30% ethyl acrylate, still even more preferably comprises from 80 to 100% C4-C8 acrylate and from 0 to 20% ethyl acrylate, still even more preferably comprises from 90 to 100% C4-C8 acrylate and from 0 to 10% ethyl acrylate and still even more preferably comprises (essentially) 100% C4-C8 acrylate.

The amount of monomer C in the copolymer may range from 30 to 70 wt %, preferably from 25 to 60 wt %, and more preferably from 40 to 65 wt % of the total copolymer.

In some embodiments (C) may comprise 70 to 99.9% C4-C8 acrylate and from 0.01 to 30% ethyl acrylate.

More preferably, from 50 to 100% of the C4-C8 component is preferably butyl.

As discussed in more detail below it has now been found that a copolymer derived from inclusion of monomer C according to the invention provides a thickening system that can enhance cleaning results for a detergent composition as compared to a corresponding copolymer, wherein monomer C is based on lower amounts of C4-C8 acrylate and higher amounts of ethyl acrylate.

Fourth Monomer D

The fourth ethylenically unsaturated monomer, consists of a surfmer of formula (III):

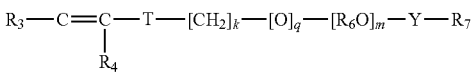

(III)

wherein $R_3$ and $R_4$ are each independently selected from H, $C_{1-3}$ alkyl such as methyl, —C(=O)OH, or C(=O)$OR_5$; and $R_5$ is a $C_1$-$C_{30}$ alkyl;

T is —$CH_2$C(=O)O—, —C(=O)O—, —O—, —$CH_2$O—, —NHC(=O)NH—, —C(=O)NH—, —Ar—$(CE_2)_z$-NHC(=O)O—, —Ar—$(CE_2)_z$-NHC(=O)NH—, or $CH_2CH_2$NHC(=O)—;

Ar is divalent aryl;

E is H or methyl;

z is 0 or 1;

k is an integer in the range of 0 to 30; and q is 0 or 1;

with the proviso that when k is 0, q is 0, and when k is in the range of 1 to 30; q is 1;

$(R_6O)_m$ is polyoxyalkylene, which is a homopolymer, a random copolymer, or a block copolymer of $C_2$-$C_4$-oxyalkylene units, wherein $R_6$ is $C_2H_4$, $C_3H_6$, $C_4H_8$, or a mixture thereof, and m is an integer in the range of 5 to 250; Y is —$R_6$O—, —$R_6$H—, —C(=O)—, —C(=O)NH—, =$R_6$NHC(=O)NH—, or —C(=O)NHC(=O)—; and $R_7$ is substituted or unsubstituted alkyl selected from the group consisting of $C_8$-$C_{40}$ linear alkyl, $C_8$-$C_{40}$ branched alkyl, $C_8$-$C_{40}$ carbocyclic alkyl, $C_2$-$C_{40}$ alkyl-substituted, phenyl, aryl-substituted $C_2$-$C_{40}$ alkyl, and $C_8$-$C_{80}$ complex ester; wherein the $R_7$ group optionally comprises one or more substituents selected from the group consisting of hydroxy, alkoxy, and halogen.

Preferably Surfmer D has the formula (IV)

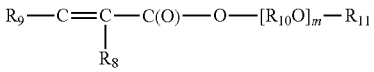

(IV)

where:

$R_8$ and $R_9$ are each independently selected from H, and $C_{1-3}$ alkyl;

$R_{10}$ is $C_2$-$C_4$ and mixtures thereof, preferably $C_2$;

m, the average number of alkoxy units $R_{10}$O, is from 6 to 40;

$R_{11}$ is alkyl or alkylaryl where the alkyl part is linear or branched; and the total number of carbons is from 10 to 40.

The fourth monomer D is more preferably a surfmer of formula (V).

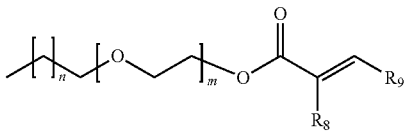

(V)

in which each $R_8$ and $R_9$ are independently selected from H, $C_1$ to $C_3$ alkyl Preferably $R_8$ is a methyl group and $R_9$ is H.

n ranges from 6 to 40 and m ranges from 6 to 40, preferably n ranges from 10 to 30 and/or m ranges 15 to 35. Most preferably n ranges from 12 to 22 and/or m ranges from 20 to 30. It is preferable that m is greater or equal to n.

The amount of surfmer D in the copolymer may range from 1 to 25 wt %, preferably from 3 to 20 wt %, and more preferably from 2 to 12 wt % of the total copolymer.

Cross Linking Agent E

Although linear polymers are preferred for the weight efficiency benefit of the present invention it may be desirable for other reasons to include as component E a cross-linking agent, such as a monomer having two or more ethylenic unsaturated groups, with the copolymer components during polymerization. Crosslinked copolymers have modified properties that can provide specific rheologies for particular applications as is generally known to the skilled worker. Illustrative examples of suitable cross linkers are divinyl benzene, divinyl naphthalene, trivinyl benzene, triallyl pentaerythritol, diallyl pentaerythritol, diallyl sucrose, octaallyl sucrose, trimethylol propane diallyl ether, 1,6-hexanediol di(meth) acrylate, tetramethylene tri(meth) acrylate, trimethylol propane tri(meth)acrylate, polyethoxylated glycol di(meth) acrylate, alkylene bisacrylamides, bisphenol A polyethyoxylated dimethacrylate, trimethylolpropane polyethoxylated trimethacrylate, ethylene glycol dimethacrylate and butylene glycol dimethacrylate, diallyl phthalate, allyl methacrylate, diacrylobutylene and similar materials. Preferred for the present invention is bisphenol A polyethoxylated glycol diacrylate, diallyl pentaerythritol and trimethylolpropane triacrylate.

When it is present, the amount of the cross linking agent used in the copolymerisation may range from 0.005 to 5 wt %, preferably from 0.05 to 3 wt %, more preferably from 1 to 2 wt %, optimally from 0.2 to 1 wt % of the total monomers.

Preferably the level of copolymer in the thickening system is at least 0.3 wt %, more preferably at least 0.6 wt % of the copolymer (ii). Because the copolymer is very weight effective the composition advantageously comprises less than 1.5 wt %, even less than 1 wt % of the copolymer (ii).

Polyamine

The ethoxylated polyamines (EPEI) are generally linear or branched poly (>2) amines. The amines may be primary, secondary or tertiary. A single or a number of amine functions are reacted with one or more alkylene oxide groups to form a polyalkylene oxide side chain. The alkylene oxide can be a homopolymer (for example ethylene oxide) or a random or block copolymer. The terminal group of the alkylene oxide side chain can be further reacted to give an anionic character to the molecule (for example to give carboxylic acid or sulphonic acid functionality).

The composition comprises from about 0.01% to about 5% polyamine. Preferably, the polyamine is a soil release agent comprising a polyamine backbone corresponding to the formula:

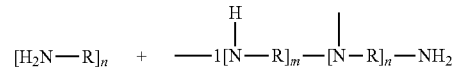

having a modified polyamine formula V(n+1)WmYnZ, or a polyamine backbone corresponding to the formula:

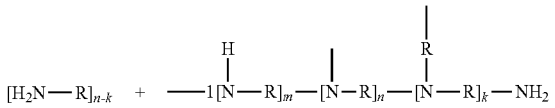

having a modified polyamine formula V(nk+1)WmYnY'kZ, wherein k is less than or equal to n, Preferably, the polyamine backbone prior to modification has a molecular weight greater than about 200 daltons.

Preferably, i) V units are terminal units having the formula:

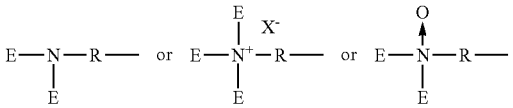

ii) W units are backbone units having the formula

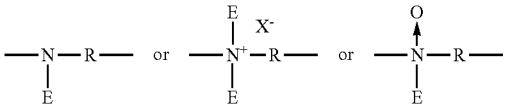

iii) Y units are branching units having the formula: and

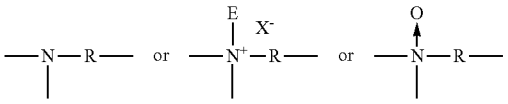

iv) Z units are terminal units having the formula:

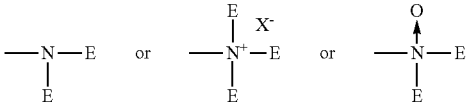

Preferably, backbone linking R units are selected from the group consisting of C2-C12 alkylene, —(R1O)xR3(OR1)x-, —($CH_2$CH(OR2)$CH_2$O)z(R1O)yR1(O$CH_2$CH(OR2)$CH_2$)w-, —$CH_2$CH(OR2)$CH_2$— and mixtures thereof, provided that when R comprises C1-C12 alkylene R also comprises at least one —(R1O)xR3(OR1)x-, —($CH_2$CH(OR2)$CH_2$O)z(R1O)yR1-(O$CH_2$CH(OR2)$CH_2$)w-, or —$CH_2$CH(OR2)$CH_2$-unit;

Preferably, R1 is C2-C6 alkylene and mixtures thereof;

Preferably, R2 is hydrogen, (R1O)XB, and mixtures thereof;

Preferably, R3 is C1-C12 alkylene, C3-C12 hydroxyalkylene, C4-C12 dihydroxy-alkylene, C8-C12 dialkylarylene, —C(O)—, —C(O)NHR5NHC(O)—, C(O)(R4)rC(O)—, —$CH_2$CH(OH)$CH_2$O(R1O)yR1O—$CH_2$CH(OH)$CH_2$—, and mixtures thereof;

Preferably, R4 is C1-C12 alkylene, C4-C12 alkenylene, C8-C12 arylalkylene, C6-C10 arylene, and mixtures thereof;

Preferably, R5 is C2-C12 alkylene or C6 C12 arylene;

Preferably, E units are selected from the group consisting of ($CH_2$)p-$CO_2$M, ($CH_2$)q$SO_3$M, —CH($CH_2CO_2$)$CO_2$M, ($CH_2$)p$PO_3$M, —(R1O)xB, and mixtures thereof, Preferably, B is hydrogen, —($CH_2$)q$SO_3$M, —($CH_2$)p$CO_2$M, —($CH_2$)q CH($SO_3$)$CH_2SO_3$M, —($CH_2$)qCH($SO_2$)$CH_2SO_3$M, —($CH_2$)p$PO_3$M, —$PO_3$M, and mixtures thereof, Preferably, M is hydrogen or a water soluble cation in sufficient amount to satisfy charge balance;

Preferably X is a water soluble anion;

Preferably k has the value from 0 to about 20;

Preferably m has the value from 4 to about 400;

Preferably n has the value from 0 to about 200;

Preferably p has the value from 1 to 6,

Preferably q has the value from 0 to 6;

Preferably r has the value 0 or 1;

Preferably w has the value 0 or 1;

Preferably x has the value from 1 to 100;

Preferably y has the value from 0 to 100; and

Preferably z has the value 0 or 1.

Preferred example compositions contain ethoxylated polyethylene imine.

Other Ingredients

The copolymers may be used with other thickeners to make up the thickening system. Preferred co-thickeners are other thickening polymers and thickening clays. Use with other thickening ingredients can further reduce the amount of polymer required.

Preferably the surfactant system comprises at least 3 wt % of anionic surfactant, most preferably the anionic surfactant comprises linear alkyl benzene sulphonate.

Advantageously the composition comprises one or more further polymers that are included in the composition for purposes other than rheology modification. Such further polymers may reduce the viscosity of the compositions and this reduction can be compensated for by the inclusion of the thickening polymer. Preferred polymers are ethoxylated polyethylene imine and/or polyester soil release polymer. Both of these polymers have been found to thin the detergent compositions. Preferably the detergent liquid further comprises at least 1 wt % ethoxylated polyethylene imine polymer. Most preferably it further comprises at least 0.5 wt % of polyester soil release polymers. More preferably the composition comprises at least 3 wt % of ethoxylated polyethylene imine.

The detergent composition may comprise an effective amount of at least one enzyme selected from the group comprising, pectate lyase, protease, amylase, cellulase, lipase, mannanase. Advantageously it comprises at least 2 of this group of enzymes, more advantageously at least 3 and most advantageously at least 4 of the enzymes from this group.

Enzyme Stabilizers:

Any enzyme present in the composition may be stabilized using conventional stabilizing agents, e.g., a polyol for example propylene glycol or glycerol, a sugar or sugar alcohol, lactic acid, boric acid, or a boric acid derivative, e.g., an aromatic borate ester, or a phenyl boronic acid derivative for example 4-formylphenyl boronic acid, and the composition may be formulated as described in e.g. WO 92/19709 and WO 92/19708.

Lignin Compounds:

When a lipase enzyme is included a lignin compound may be used in the composition in an amount that can be optimised by trial and error. Lignin is a component of all vascular plants, found mostly between cellular structures but also within the cells and in the cell walls.

Preferably the lignin compound comprises a lignin polymer and more preferably it is a modified lignin polymer. A modified lignin polymer as used herein is lignin that has been subjected to a chemical reaction to attach chemical moieties to the lignin covalently. The attached chemical moieties are preferably randomly substituted.

Preferred modified lignin polymers are lignins that have been substituted with anionic, cationic or alkoxy groups, or mixtures thereof. Preferably the substitution occurs on the aliphatic portion of the lignin and is random. Preferably the modified lignin polymer is substituted with an anionic group, and preferably it is a sulfonate. A preferred cationic group is a quaternary amine. Preferred alkoxy groups are polyalkylene oxide chains having repeat units of alkoxy moieties in the range from 5 to 30, most preferably ethoxy. Preferably the modified lignin sulfonate is substituted with anionic or alkoxy groups. Modified lignin polymers are discussed in WO/2010/033743. Most preferably the modified lignin polymer is lignin sulfonate (lignosulfonate). Lignin sulfonate may be obtained by the Howard process.

Exemplary lignin sulfonate may be obtained from a variety of sources including hardwoods, softwoods and recycling or effluent streams. The lignin sulfonate may be utilized in crude or pure forms, e.g., in an "as is" or whole liquor condition, or in a purified lignin sulfonate form from which or in which sugars and other saccharide constituents have been removed or destroyed, or from which or in which inorganic constituents have been partially or fully eliminated. The lignin sulfonate may be utilized in salt forms including calcium lignin sulfonate, sodium lignin sulfonate, ammonium lignin sulfonate, potassium lignin sulfonate, magnesium lignin sulfonate and mixtures or blends thereof.

The lignin sulfonate preferably has a weight average molecular weight of from 2000 to 100000. Their basic structural unit is phenylpropane. The degree of sulphonation is preferably from 0.3 and 1.0 sulfate groups per phenylpropane unit. Lignin sulfonates are available from a number of suppliers including Borregaard LignoTech, Georgia-Pacific Corporation, Lenzing AG and Tembec Inc.

Lignin sulphonates are discussed in Lauten, R. A., Myrvold, B. O. and Gundersen, S. A. (2010) New Developments in the Commercial Utilization of Lignosulphonates, in Surfactants from Renewable Resources (eds M. Kjellin and I. Johansson), John Wiley & Sons, Ltd, Chichester, UK.

Fluorescent Agents:

It may be advantageous to include fluorescer in the compositions. Usually, these fluorescent agents are supplied and used in the form of their alkali metal salts, for example, the sodium salts. The total amount of the fluorescent agent or agents used in the composition is generally from 0.005 to 2 wt %, more preferably 0.01 to 0.5 wt %.

Preferred classes of fluorescer are: Di-styryl biphenyl compounds, e.g. Tinopal (Trade Mark) CBS-X, Di-amine stilbene di-sulphonic acid compounds, e.g. Tinopal DMS pure Xtra, Tinopal SBMGX, and Blankophor (Trade Mark) HRH, and Pyrazoline compounds, e.g. Blankophor SN.

Preferred fluorescers are: sodium 2 (4-styryl-3-sulfophenyl)-2H-napthol[1,2-d]triazole, disodium 4,4'-bis{[(4-anilino-6-(N methyl-N-2 hydroxyethyl) amino 1,3,5-triazin-2-yl)]amino}stilbene-2-2' disulfonate, disodium 4,4'-bis{[(4-anilino-6-morpholino-1,3,5-triazin-2-yl)]amino} stilbene-2-2' disulfonate, and disodium 4,4'-bis(2-sulfoslyryl)biphenyl.

Bleach Catalyst:

Compositions may comprise a weight efficient bleach system. Such systems typically do not utilise the conventional percarbonate and bleach activator approach. An air bleach catalyst system is preferred. Suitable complexes and organic molecule (ligand) precursors for forming complexes are available to the skilled worker, for example, from: WO 98/39098; WO 98/39406, WO 97/48787, WO 00/29537; WO 00/52124, and WO00/60045, incorporated by reference. An example of a preferred catalyst is a transition metal complex of MeN4Py ligand (N,N-bis(pyridin-2-yl-methyl)-1-,1-bis(pyridin-2-yl)-1-aminoethane). Suitable bispidon catalyst materials and their action are described in WO02/48301. The bleach catalyst may be encapsulated to reduce interaction with other components of the liquid during storage.

Photobleaches may also be employed. A "photobleach" is any chemical species that forms a reactive bleaching species on exposure to sunlight, and preferably is not permanently consumed in the reaction. Preferred photo-bleaches include singlet oxygen photo-bleaches and radical photo-bleaches. Suitable singlet oxygen photo-bleaches may be selected from, water soluble phthalocyanine compounds, particularly metallated phthalocyanine compounds where the metal is Zn or Al—Z1 where Z1 is a halide, sulphate, nitrate, carboxylate, alkanolate or hydroxyl ion. Preferably the phthalocyanin has 1-4 $SO_3X$ groups covalently bonded to it where X is an alkali metal or ammonium ion. Such compounds are described in WO2005/014769 (Ciba).

When present, the bleach catalyst is typically incorporated at a level of about 0.0001 to about 10 wt %, preferably about 0.001 to about 5 wt %.

Perfume

When the composition is used at very low levels of product dosage, it is advantageous to ensure that perfume is employed efficiently.

A particularly preferred way of ensuring that perfume is employed efficiently is to use an encapsulated perfume. Use of a perfume that is encapsulated reduces the amount of perfume vapour that is produced by the composition before it is diluted. This is important when the perfume concentration is increased to allow the amount of perfume per wash to be kept at a reasonably high level.

It is even more preferable that the perfume is not only encapsulated but also that the encapsulated perfume is provided with a deposition aid to increase the efficiency of perfume deposition and retention on fabrics. The deposition aid is preferably attached to the encapsulate by means of a covalent bond, entanglement or strong adsorption, preferably by a covalent bond or entanglement.

Further Optional Ingredients:

The compositions may contain one or more other ingredients. Such ingredients include foam boosting agents, preservatives (e.g. bactericides), pH buffering agents, polyelectrolytes, anti-shrinking agents, anti-wrinkle agents, anti-oxidants, sunscreens, anti-corrosion agents, drape imparting agents, anti-static agents and ironing aids. The compositions may further comprise colorants, pearlisers and/or opacifiers, and shading dye.

Shading Dyes

Shading dye can be used to improve the performance of the compositions. Preferred dyes are violet or blue. It is believed that the deposition on fabrics of a low level of a dye of these shades, masks yellowing of fabrics. A further advantage of shading dyes is that they can be used to mask any yellow tint in the composition itself.

Suitable and preferred classes of dyes are discussed below.

Direct Dyes:

Direct dyes (otherwise known as substantive dyes) are the class of water soluble dyes which have an affinity for fibres and are taken up directly. Direct violet and direct blue dyes are preferred.

Preferably bis-azo or tris-azo dyes are used.

Most preferably, the direct dye is a direct violet of the following structures:

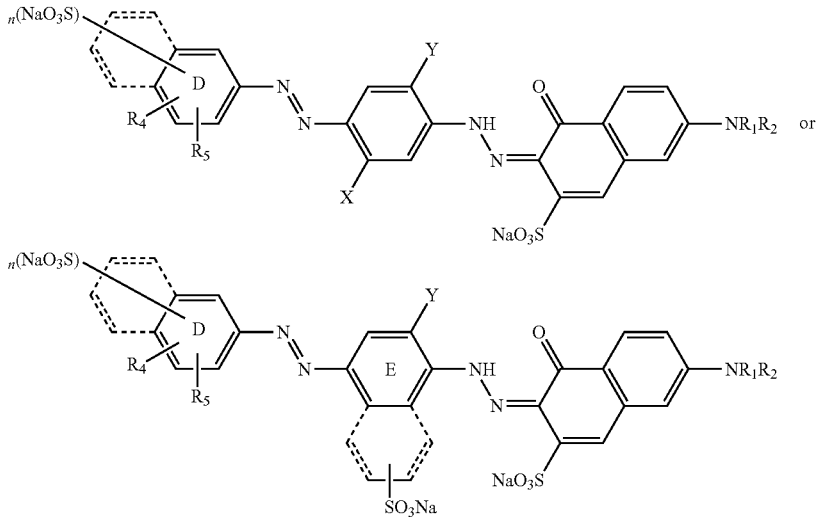

wherein:

ring D and E may be independently naphthyl or phenyl as shown;

$R_1$ is selected from: hydrogen and $C_1$-$C_4$-alkyl, preferably hydrogen;

$R_2$ is selected from: hydrogen, $C_1$-$C_4$-alkyl, substituted or unsubstituted phenyl and substituted or unsubstituted naphthyl, preferably phenyl;

$R_4$ and $R_5$ are independently selected from: hydrogen and $C_1$-$C_4$-alkyl, preferably hydrogen or methyl;

X and Y are independently selected from: hydrogen, $C_1$-$C_4$-alkyl and $C_1$-$C_4$-alkoxy; preferably the dye has X=methyl; and, Y=methoxy and n is 0, 1 or 2, preferably 1 or 2.

Preferred dyes are direct violet 7, direct violet 9, direct violet 11, direct violet 26, direct violet 31, direct violet 35, direct violet 40, direct violet 41, direct violet 51, and direct violet 99. Bis-azo copper containing dyes for example direct violet 66 may be used. The benzidene based dyes are less preferred.

Preferably the direct dye is present at 0.000001 to 1 wt % more preferably 0.00001 wt % to 0.0010 wt % of the composition.

In another embodiment the direct dye may be covalently linked to the photobleach, for example as described in WO2006/024612.

Acid Dyes:

Cotton substantive acid dyes give benefits to cotton containing garments. Preferred dyes and mixes of dyes are blue or violet. Preferred acid dyes are:

(i) azine dyes, wherein the dye is of the following core structure:

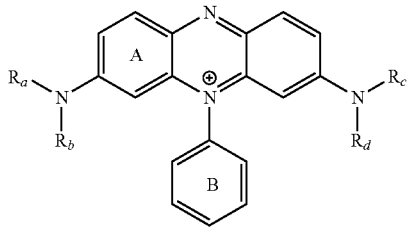

wherein $R_a$, $R_b$, $R_c$ and $R_d$ are selected from: H, a branched or linear C1 to C7-alkyl chain, benzyl a phenyl, and a naphthyl;

the dye is substituted with at least one $SO_3^-$ or —$COO^-$ group;

the B ring does not carry a negatively charged group or salt thereof; and the A ring may further substituted to form a naphthyl; the dye is optionally substituted by groups selected from: amine, methyl, ethyl, hydroxyl, methoxy, ethoxy, phenoxy, Cl, Br, I, F, and $NO_2$.

Preferred azine dyes are: acid blue 98, acid violet 50, and acid blue 59, more preferably acid violet 50 and acid blue 98.

Other preferred non-azine acid dyes are acid violet 17, acid black 1 and acid blue 29.

Preferably the acid dye is present at 0.0005 wt % to 0.01 wt % of the formulation.

Hydrophobic Dyes:

The composition may comprise one or more hydrophobic dyes selected from benzodifuranes, methine, triphenylmethanes, napthalimides, pyrazole, napthoquinone, anthraquinone and mono-azo or di-azo dye chromophores. Hydrophobic dyes are dyes which do not contain any charged water solubilising group. Hydrophobic dyes may be selected from the groups of disperse and solvent dyes. Blue and violet anthraquinone and mono-azo dye are preferred.

Preferred dyes include solvent violet 13, disperse violet 27 disperse violet 26, disperse violet 28, disperse violet 63 and disperse violet 77.

Preferably the hydrophobic dye is present at 0.0001 wt % to 0.005 wt % of the formulation.

Basic Dyes:

Basic dyes are organic dyes which carry a net positive charge. They deposit onto cotton. They are of particular utility for used in composition that contain predominantly cationic surfactants. Dyes may be selected from the basic violet and basic blue dyes listed in the Colour Index International.

Preferred examples include triarylmethane basic dyes, methane basic dye, anthraquinone basic dyes, basic blue 16, basic blue 65, basic blue 66, basic blue 67, basic blue 71, basic blue 159, basic violet 19, basic violet 35, basic violet 38, basic violet 48; basic blue 3, basic blue 75, basic blue 95, basic blue 122, basic blue 124, basic blue 141.

Reactive Dyes:

Reactive dyes are dyes which contain an organic group capable of reacting with cellulose and linking the dye to cellulose with a covalent bond. They deposit onto cotton.

Preferably the reactive group is hydrolysed or reactive group of the dyes has been reacted with an organic species for example a polymer, so as to the link the dye to this species. Dyes may be selected from the reactive violet and reactive blue dyes listed in the Colour Index International.

Preferred examples include reactive blue 19, reactive blue 163, reactive blue 182 and reactive blue, reactive blue 96.

Dye Conjugates:

Dye conjugates are formed by binding direct, acid or basic dyes to polymers or particles via physical forces. Dependent on the choice of polymer or particle they deposit on cotton or synthetics. A description is given in WO2006/055787.

Particularly preferred dyes are: direct violet 7, direct violet 9, direct violet 11, direct violet 26, direct violet 31, direct violet 35, direct violet 40, direct violet 41, direct violet 51, direct violet 99, acid blue 98, acid violet 50, acid blue 59, acid violet 17, acid black 1, acid blue 29, solvent violet 13, disperse violet 27 disperse violet 26, disperse violet 28, disperse violet 63, disperse violet 77 and mixtures thereof.

Shading dye can be used in the absence of fluorescer, but it is especially preferred to use a shading dye in combination with a fluorescer, for example in order to reduce yellowing due to chemical changes in adsorbed fluorescer.

Builders and Sequestrants

The detergent compositions may also optionally contain relatively low levels of organic detergent builder or sequestrant material. Examples include the alkali metal, citrates, succinates, malonates, carboxymethyl succinates, carboxylates, polycarboxylates and polyacetyl carboxylates. Specific examples include sodium, potassium and lithium salts of oxydisuccinic acid, mellitic acid, benzene polycarboxylic acids, and citric acid. Other examples are DEQUEST™, organic phosphonate type sequestering agents sold by Monsanto and alkanehydroxy phosphonates.

Other suitable organic builders include the higher molecular weight polymers and copolymers known to have builder properties. For example, such materials include appropriate polyacrylic acid, polymaleic acid, and polyacrylic/polymaleic acid copolymers and their salts, for example those sold by BASF under the name SOKALAN™.

If utilized, the organic builder materials may comprise from about 0.5% to 20 wt %, preferably from 1 wt % to 10 wt %, of the composition. The preferred builder level is less than 10 wt % and preferably less than 5 wt % of the composition. A preferred sequestrant is HEDP (1-Hydroxyethylidene-1,1,-diphosphonic acid), for example sold as Dequest 2010. Also suitable but less preferred as it gives inferior cleaning results is Dequest® 2066 (Diethylenetriamine penta(methylene phosphonic acid or Heptasodium DTPMP).

Buffers

The presence of some buffer is preferred for pH control; preferred buffers are MEA, and TEA. If present they are preferably used in the composition at levels of from 1 to 15 wt %.

External Structurants

The compositions may have their rheology further modified by use of a material or materials that form a structuring network within the composition. Suitable structurants include hydrogenated castor oil, microfibrous cellulose and natural based structurants for example citrus pulp fibre. Citrus pulp fibre is particularly preferred especially if lipase enzyme is included in the composition.

Visual Cues

The compositions may comprise visual cues of solid material that is not dissolved in the composition. Preferred visual cues are lamellar cues formed from polymer film and possibly comprising functional ingredients that may not be as stable if exposed to the alkaline liquid. Enzymes and bleach catalysts are examples of such ingredients. Also perfume, particularly microencapsulated perfume.

Packaging and Dosing

Preferably the liquids are supplied in multidose plastics packs with a top or bottom closure. A dosing measure may be supplied with the pack either as a part of the cap or as an integrated system.

The invention will now be further described with reference to the following non-limiting examples.

EXAMPLES

Surfmer Synthesis

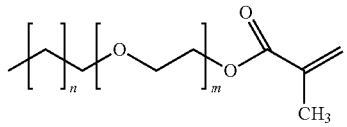

n = 12
m = 23

Brij® 35P (150 g) from Sigma Aldrich was dissolved in 500 ml anhydrous dichloromethane under a nitrogen atmosphere and cooled in an ice bath to 5° C. Triethylamine (18.6 g) was added via syringe before methacryloyl chloride (20.9 g) was added dropwise over a 30 minute period. After complete addition, the solution was allowed to warm to room temperature and the reaction stirred for 4 weeks. The solution was then filtered to remove the resulting precipitate and washed once with saturated sodium hydrogen carbonate solution (200 ml) and once with saturated brine (200 ml). The solution was then passed through a column containing basic alumina before the product was dried with anhydrous magnesium sulphate, filtered and the solvent removed in vacuo. This surfmer product is hereinafter referred to as Surfmer A.

Synthetic Process for Copolymers.

Copolymer 2 Containing BA:EA (75:25):

A round bottom flask was charged with butyl acrylate (37.00 g), ethyl acrylate (12.34 g), methacrylic acid (25.00 g) and Brij 35 Surfmer (8.20 g). The mixture was sealed and purged with nitrogen for 60 minutes before sodium dodecyl sulfonate (0.76 g) and deoxygenated water (20 g) was added and stirred forming a pre-emulsion. A multineck round bottom flask was fitted with a nitrogen sparge and overhead stirrer. Deoxygenated water (200 g) and sodium dodecyl sulfonate (0.22 g) were added, stirred at 200 rpm and heated to 90° C. Ammonium persulfate (0.054 g) in water (1 ml) was added via syringe. The pre-emulsion was fed into the surfactant solution via peristaltic pump over 120 minutes. After complete addition, ammonium persulfate (0.024 g) in water (1 ml) was added and the reaction stirred for a further 180 minutes. The emulsion was allowed to cool before being bottled up.

The resulting copolymer, obtained using the combination of 75% butyl acrylate and 25% ethyl acrylate as monomer (C) was designated Copolymer 2.

Copolymer 1 was produced in a similar manner using 100% butyl acrylate as monomer (C).

Comparative copolymers 3 and 4 were prepared in a similar fashion using, as monomer (C), the combination of 25% butyl acrylate and 75% ethyl acrylate or 100% ethyl acrylate, respectively.

Examples 1 and 2 and Comparative Examples A and B

Detergent compositions were prepared using the components listed below.

Examples 1 and 2 contained copolymer 1 and 2, respectively, as "copolymer thickener". For Comparative Examples A and B copolymers 3 and 4, respectively, were employed.

Detergent Compositions

| Raw material | Inclusion level as 100% |
|---|---|
| LAS acid | 11.20 |
| SLES 3EO | 8.40 |
| Non Ionic 7EO | 8.40 |
| Fatty Acid | 3.50 |
| MPG | 8.00 |
| Neutraliser/buffer | 10.20 |
| EPEI | 3.00 |
| Copolymer thickener* | 1.00 |
| Salts, sequestrants and builders | 4.25 |
| Perfume, colourants and minors | 1.66 |
| Water to balance | |

*Example 1 - copolymer 1, Example 2 - copolymer 2, Comparative Example A - copolymer 3, Comparative Example B - copolymer 4

LAS is linear alkyl benzene sulphonic acid, SLES 3EO is sodium lauryl ether sulphate 3EO, EPEI is ethoxylated polyethylene imine PEI (600) 20 EO and MPG is monopropylene glycol.

Stain Removal Study

Detergent compositions of Examples 1 and 2 and Comparative Examples A and B were assessed for their cleaning performance.

The wash conditions employed a 3.0 kg mixed load of 25% woven cotton, 25% cotton terry towelling and 50% woven polyester, at a dosage of 35 ml and an in-wash temperature of 40° C. SBL2004 soil strips were added to each wash and the results were monitored using PS16 multimonitor and CSS1, CSS2 and CSS3 multistain monitors.

Results

The results are reproduced below:

| | MonitorName | | | |
|---|---|---|---|---|
| | Example 1 1 (BA:EA) 100:0 | Example 2 2 (BA:EA) 75:25 | Comparative Example A A (BA:EA) 25:75 | Comparative Example B B (BA:EA) 0:100 |
| GardenSoil (1:1water) | −0.08 | −0.94 | −6.34 | −5.91 |
| Red Soil | −0.76 | −1.55 | −3.45 | −3.23 |
| RedPotteryClay | 0.06 | −0.45 | −2.22 | −1.67 |
| YellowPotteryClay | −0.23 | −1.23 | −3.56 | −2.72 |
| Red Soil | −0.97 | −0.53 | −9.26 | −6.5 |

The data shows the cleaning results achieved with compositions containing a thickener copolymer using monomer C having varying levels of butyl acrylate (BA) with ethyl acrylate (EA), in combination with ethoxylated polyamine, EPEI.

The Example 1 and Example 2 detergent compositions show improved removal of particulate stains as compared to Comparative Examples A and B.

The results show that thickening copolymers derived from monomer C having higher levels of C4-C8 acrylate are able to reduce the reduction of cleansing efficacy imparted by EPEI on such compositions. This effect is seen in comparison with copolymers derived from component C having levels of butyl acrylate and ethyl acrylate outside the claim, where no such improvement is seen.

The inclusion of at least 40% C4-C8 acrylate in the monomer component (C) for the thickening copolymer is shown to be effective to reduce cleaning negatives associated with the thickening system as compared to thickening copolymers derived from a monomer component (C) which comprises lower amounts of C4-C8 acrylate.

The invention claimed is:

1. A thickened aqueous detergent liquid composition comprising:

(i) at least 5 wt % of a surfactant system comprising anionic surfactant, (ii) a thickening system comprising a copolymer formed by the addition polymerisation of:

(A) 0 to 5 wt % of a first monomer consisting of an ethylenically unsaturated diacid of formula (I):

$$HOOC—CR_1=CR_2—COOH \quad (I)$$

or an unsaturated cyclic anhydride precursor of such an ethylenically unsaturated diacid, the anhydride having formula (II)

(II)

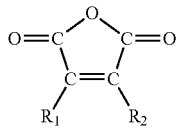

where $R_1$ and $R_2$ are individually selected from H, $C_1$-$C_3$ alkyl, phenyl, chlorine and bromine;

(B) 15 to 60 wt % of a second ethylenically unsaturated monoacidic monomer consisting of (meth)acrylic acid;

(C) 30 to 70 wt % of a third ethylenically unsaturated monomer consisting of from 70 to 99.9% C4-C8 acrylate and from 0.01 to 30% ethyl acrylate;

(D) 1 to 25 wt %, of a fourth ethylenically unsaturated monomer, consisting of surfmer of formula (III):

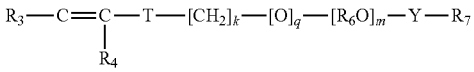

(III)

wherein each $R_3$ and $R_4$ are each independently selected from H, $C_{1-3}$ alkyl, —C(═O)OH, or —C(═O)$OR_5$;

$R_5$ is a $C_1$-$C_{30}$ alkyl;

T is —$CH_2$C(═O)O—, —C(═O)O—, —O—, —$CH_2$O—, —NHC(═O)NH—, —C(═O)NH—, —Ar—$(CE_2)_z$-NHC(═O)O—, —Ar—$(CE_2)_z$-NHC(═O)NH—, or —$CH_2CH_2$NHC(═O)—;

Ar is divalent aryl;

E is H or methyl;

z is 0 or 1;

k is an integer in the range of 0 to 30; and q is 0 or 1; with the proviso that when k is 0, q is 0, and when k is in the range of 1 to 30; q is 1;

$(R_6O)_m$ is polyoxyalkylene, which is a homopolymer, a random copolymer, or a block copolymer of $C_2$-$C_4$-oxyalkylene units, wherein $R_6$ is $C_2H_4$, $C_3H_6$, $C_4H_8$, or a mixture thereof, and m is an integer in the range of 5 to 250;Y is —$R_6$O—, —$R_6$H—, —C(═O)—, —C(═O)NH—, ═$R_6$NHC(═O)NH—, or —C(═O)NHC(═O)—; and $R_7$ is substituted or unsubstituted alkyl selected from the group consisting of $C_8$-$C_{40}$ linear alkyl, $C_8$-$C_{40}$ branched alkyl, $C_8$-$C_{40}$ carbocyclic alkyl, $C_2$-$C_{40}$ alkyl-substituted, phenyl, aryl-substituted $C_2$-$C_{40}$ alkyl, and $C_8$-$C_{80}$ complex ester;

wherein the $R_7$ alkyl group optionally comprises one or more substituents selected from the group consisting of hydroxy, alkoxy, and halogen and (E) 0 to 5 wt %, of a cross linking agent, for introducing branching and controlling molecular weight, the cross linking monomer comprising polyfunctional units carrying multiple reactive functionalisation groups selected from the group consisting of vinyl, allyl and functional mixtures thereof, and (iii) from 0.01 to 5% wt of the composition ethoxylated polyamine.

2. A composition according to claim 1 wherein fourth monomer D is a Surfmer with formula (IV):

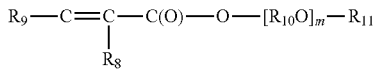

(IV)

where:

$R_8$ and $R_9$ are each independently selected from H, and $C_{1-3}$ alkyl;

$R_{10}$ is $C_2$-$C_4$ and mixtures thereof;

m, the average number of alkoxy units $R_{10}O$, is from 6 to 40;

$R_{11}$ is alkyl or alkylaryl where the alkyl part is linear or branched; and the total number of carbons is from 10 to 40.

3. A composition according to claim 1 wherein the fourth monomer D is a Surfmer with formula (V):

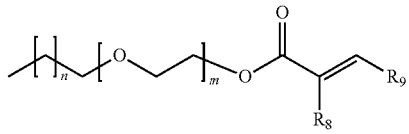

(V)

in which each $R_8$ and $R_9$ are independently selected from H, $C_1$ to $C_3$ alkyl, n ranges from 10 to 30 and m ranges 15 to 35.

4. A composition according to claim 1 wherein the copolymer contains 0% of cross linker E and is linear.

5. A composition according to claim 1 wherein (C) comprises, as C4-C8 acrylate, butyl acrylate.

6. A composition according to claim 1 wherein the viscosity of the liquid at 20 $s^{-1}$ and 25° C. is at least 0.2 Pa·s.

7. A composition according to claim 1 comprising at least 0.3 wt % of the copolymer (ii).

8. A composition according to claim 1 wherein the anionic surfactant is selected from the group consisting of alkyl benzene sulphonate, and alkyl sulphate.

9. A composition according to claim 1 wherein the anionic surfactant comprises linear alkyl benzene sulphonate, sodium salt.

10. A composition according to claim 1 wherein the composition further includes a viscosity reducing polymer selected from polyester soil release polymers.

11. A composition according to claim 1 wherein the copolymer (ii) has a molecular weight Mw of at least 500,000 Daltons.

12. A composition according to claim 1 in which the first monomer (A) in copolymer (ii) is maleic anhydride.

* * * * *